US008408688B2

(12) United States Patent
Asami et al.

(10) Patent No.: US 8,408,688 B2
(45) Date of Patent: Apr. 2, 2013

(54) BUBBLE TOLERANT MANIFOLD DESIGN FOR A LIQUID EJECTING HEAD

(75) Inventors: Masahiro Asami, Shiojiri (JP); Hiroyuki Ishikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 93 days.

(21) Appl. No.: 13/170,127

(22) Filed: Jun. 27, 2011

(65) Prior Publication Data

US 2011/0316948 A1 Dec. 29, 2011

(30) Foreign Application Priority Data

Jun. 29, 2010 (JP) ..... 2010-147240

(51) Int. Cl.
*B41J 2/19* (2006.01)

(52) U.S. Cl. ..... 347/92; 347/40; 347/85

(58) Field of Classification Search ..... 347/15, 347/40, 43, 68–72, 84–86, 89–94
See application file for complete search history.

(56) References Cited

U.S. PATENT DOCUMENTS 5,455,615 A * 10/1995 Burr et al. ..... 347/92
5,509,140 A * 4/1996 Koitabashi et al. ..... 347/86

FOREIGN PATENT DOCUMENTS

JP 2001-219560 A 8/2001

* cited by examiner

*Primary Examiner* — Thinh Nguyen
(74) *Attorney, Agent, or Firm* — Kilpatrick Townsend & Stockton LLP

(57) ABSTRACT

A liquid ejecting head includes pressure generating chambers; nozzles that communicate with respective pressure generating chambers; a manifold that communicates with a liquid introduction opening and that serves as a common flow channel for the multiple pressure generating chambers; liquid supply channels, having liquid supply openings that open into the manifold, that communicate between the manifold and the pressure generating chambers; and a pressure generating element that causes liquid to be ejected through the nozzles by generating pressure within the pressure generating chambers. At least one of the liquid supply openings is physically separated from at least one adjacent liquid supply opening, such as by a partition, which prevents air bubbles from moving between adjacent liquid supply openings.

24 Claims, 13 Drawing Sheets

BUBBLE TOLERANT MANIFOLD DESIGN FOR A LIQUID EJECTING HEAD

CROSS REFERENCES TO RELATED APPLICATIONS

This application claims priority to Japanese Patent Application No. 2010-147240 filed in the Japanese Patent Office on Jun. 29, 2010, the entire contents of which are incorporated herein by reference.

BACKGROUND

1. Technical Field

The present invention relates to liquid ejecting heads and liquid ejecting apparatuses. More specifically, the present invention relates to inlet geometry for the liquid supply channels for an inkjet head.

2. Related Art

An ink ejecting head that ejects liquid ink is one type of liquid ejecting head. Generally speaking, an ink ejecting head includes a manifold, pressure generating chambers, and nozzles. The ink ejecting head receives a supply of ink from an ink holding unit, such as, for example, an ink cartridge. The ink is sent from the ink cartridge to the manifold, then to the pressure generating chambers through ink supply channels, which connect the single manifold to the multiple pressure generating chambers. The ink is then ejected to the exterior through respective ones of the nozzles, via respective ink discharge channels, from the pressure generating chambers, which have been pressurized as the result of the driving of respective pressure generating elements. This can be seen in, for example, JP-A-2001-219560.

It has been confirmed that bubbles can sometimes be undesirably produced in the liquid within the manifold, because extremely small dissolved gaseous bodies within the liquid expand due to rises in the temperature of the liquid, drops in atmospheric pressure, and so on, and the expanded gaseous bodies then appear as bubbles. This can be problematic, because even a very small number of bubbles can block the liquid from being ejected through the nozzles.

The following explanations must not be considered as limiting the scope of the invention in any respect whatsoever.

When bubbles form, the bubbles tend to, for the most part, move along with the liquid from the ink cartridge into the manifold, toward the liquid supply channels. In the case where the bubbles that have been produced are too large to be sucked into the liquid supply channels, those bubbles cover the inlets of the liquid supply channels. As a result, the flow of the liquid from the manifold to the pressure generating chambers is cut off. In this state, if the driving of the pressure generating elements is continued in a state where the flow of the liquid from the manifold to the liquid supply channels has been cut off, the air can build up within the pressure generating chambers.

When the air has built up, the pressure generating elements can generate an insufficient amount of pressure within the pressure generating chambers to eject the liquid through the nozzles. If the liquid is not ejected through the nozzles, the flow of liquid from the liquid supply channels to the pressure generating chambers stops, and the suction on the bubbles that are covering the liquid supply channels from the liquid supply channel toward the pressure generating chambers stops as well.

Meanwhile, in the manifold, liquid flows toward the liquid supply channels that are not covered by the bubbles. Accordingly, due to the momentum of the liquid flow toward the liquid supply channels that are not covered by bubbles, the bubbles that cover the liquid supply channels are sucked toward the inlets of the liquid supply channels that are not covered by the bubbles. The inlets of the liquid supply channels toward which the bubbles have been sucked are then covered by the bubbles.

As described above, the flow of liquid can be cut off from the liquid supply channels that have been newly covered by the bubbles, and the liquid is therefore not ejected through the nozzles. Meanwhile, the liquid supply channels that were covered by bubbles before the bubbles moved have air built up within the pressure generating chambers. Accordingly, even if the pressure generating elements are driven, the liquid cannot flow from the liquid supply channels toward the nozzles. Accordingly, as described earlier, the bubbles move from one liquid supply channel to another liquid supply channel, thus continually increasing the number of nozzles through which liquid is not ejected, which results in liquid not being ejected simultaneously through multiple nozzles.

Note that this issue is not limited to ink heads that eject ink as their liquid; the same issue also arises in liquid ejecting heads capable of ejecting a liquid aside from ink.

SUMMARY

An advantage of some embodiments described herein is to provide a liquid ejecting head that does not easily fall into a state in which liquid is not ejected through multiple nozzles even when bubbles have been produced within a manifold. A liquid ejecting apparatus that includes such a liquid ejecting head is also provided.

A liquid ejecting head according to some exemplary embodiments includes: multiple pressure generating chambers; nozzles that communicate with respective pressure generating chambers; a manifold that communicates with a liquid introduction opening and that serves as a common flow channel for the multiple pressure generating chambers; liquid supply channels, having liquid supply openings that open into the manifold, that provide communication between the manifold and the pressure generating chambers; and a pressure generating element that causes liquid to be ejected through the nozzles by generating pressure within the pressure generating chambers. The liquid supply opening of at least one of the liquid supply channels is located in the inner surface of a depression that has an opening that opens into the manifold.

Bubbles that could block the liquid supply openings are trapped in the depressions and cannot move to other liquid supply openings. Accordingly, it is possible to prevent the occurrence of a state in which the liquid is not ejected through multiple nozzles at the same time.

A liquid ejecting head according to some exemplary embodiments includes: pressure generating chambers; nozzles; a manifold; liquid supply channels, having liquid supply openings that open into the manifold; and a pressure generating element. A partition is provided between at least one of the liquid supply openings and an adjacent liquid supply opening.

Bubbles that could block the liquid supply openings are blocked from moving to other liquid supply openings by the partitions. Accordingly, it is possible to prevent the occurrence of a state in which the liquid is not ejected through multiple nozzles at the same time.

A liquid ejecting apparatus according to some exemplary embodiments includes a liquid ejecting head such as those described above.

For a further understanding of the nature and advantages of the invention, reference should be made to the following description taken in conjunction with the accompanying figures. It is to be expressly understood, however, that each of the figures is provided for the purpose of illustration and description only and is not intended as a definition of the limits of the embodiments of the present invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
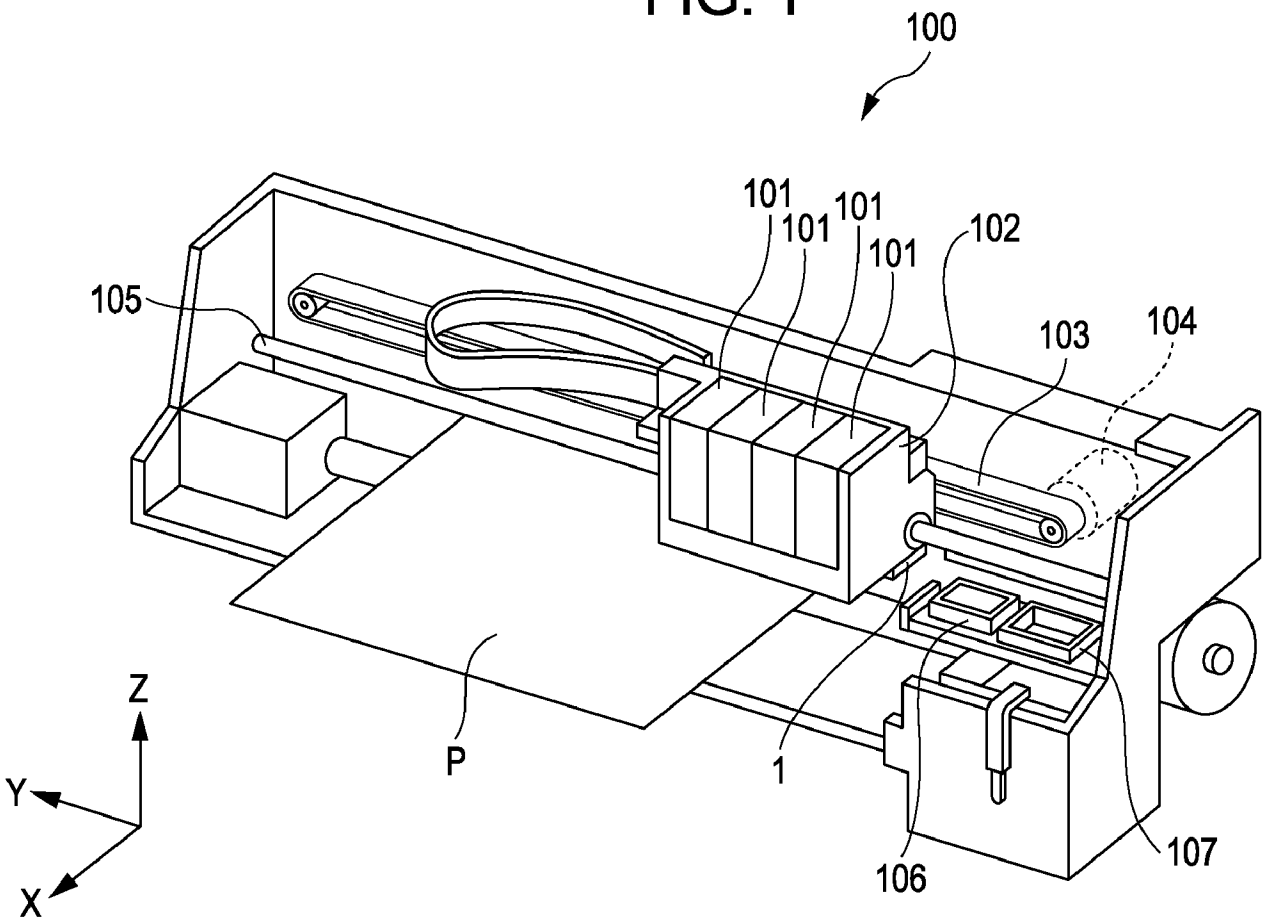
FIG. 1 is a perspective view illustrating the overall configuration of an exemplary printer.
Figure 2:
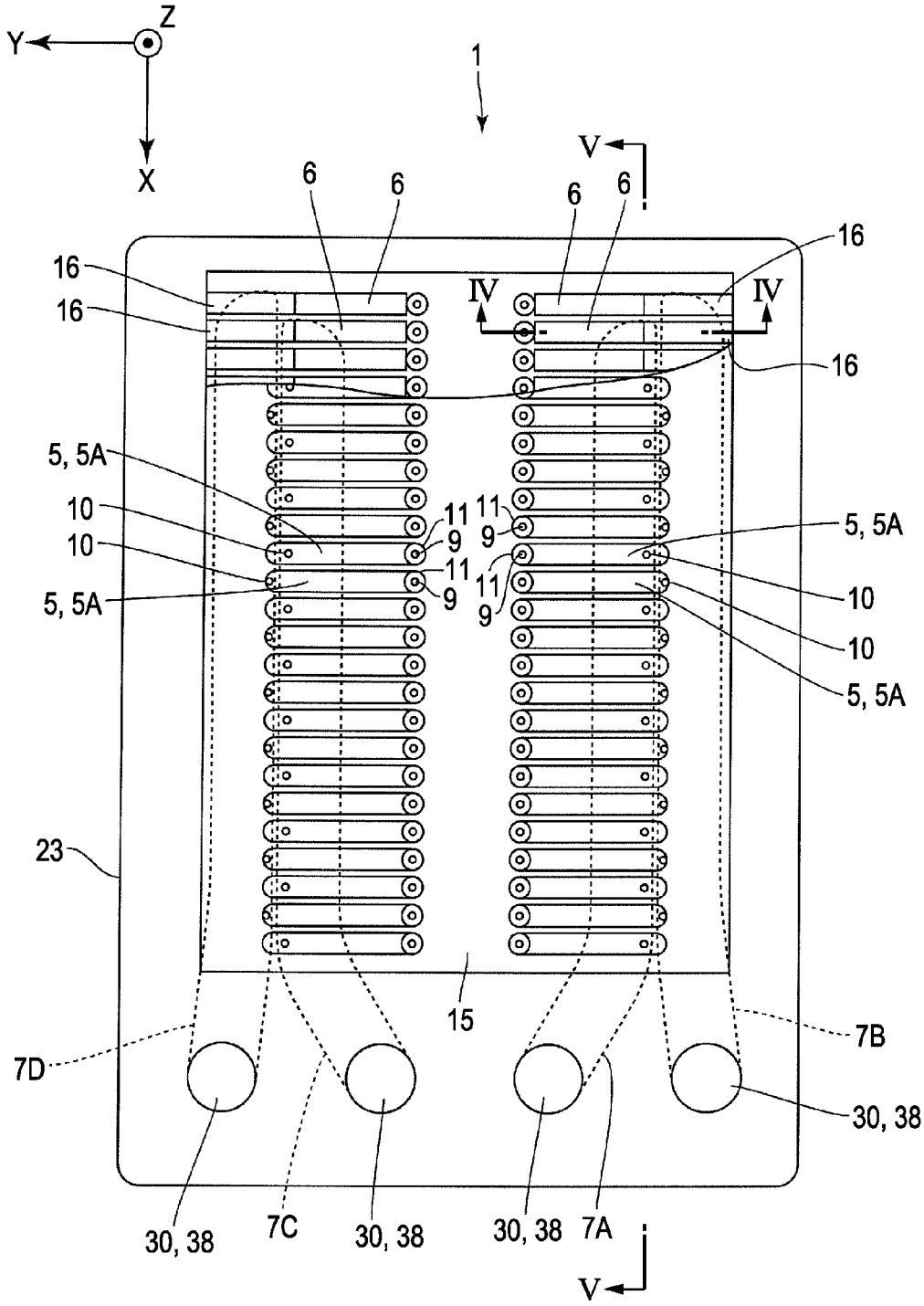
FIG. 2 is a plan view of a first exemplary ink head.
Figure 3:
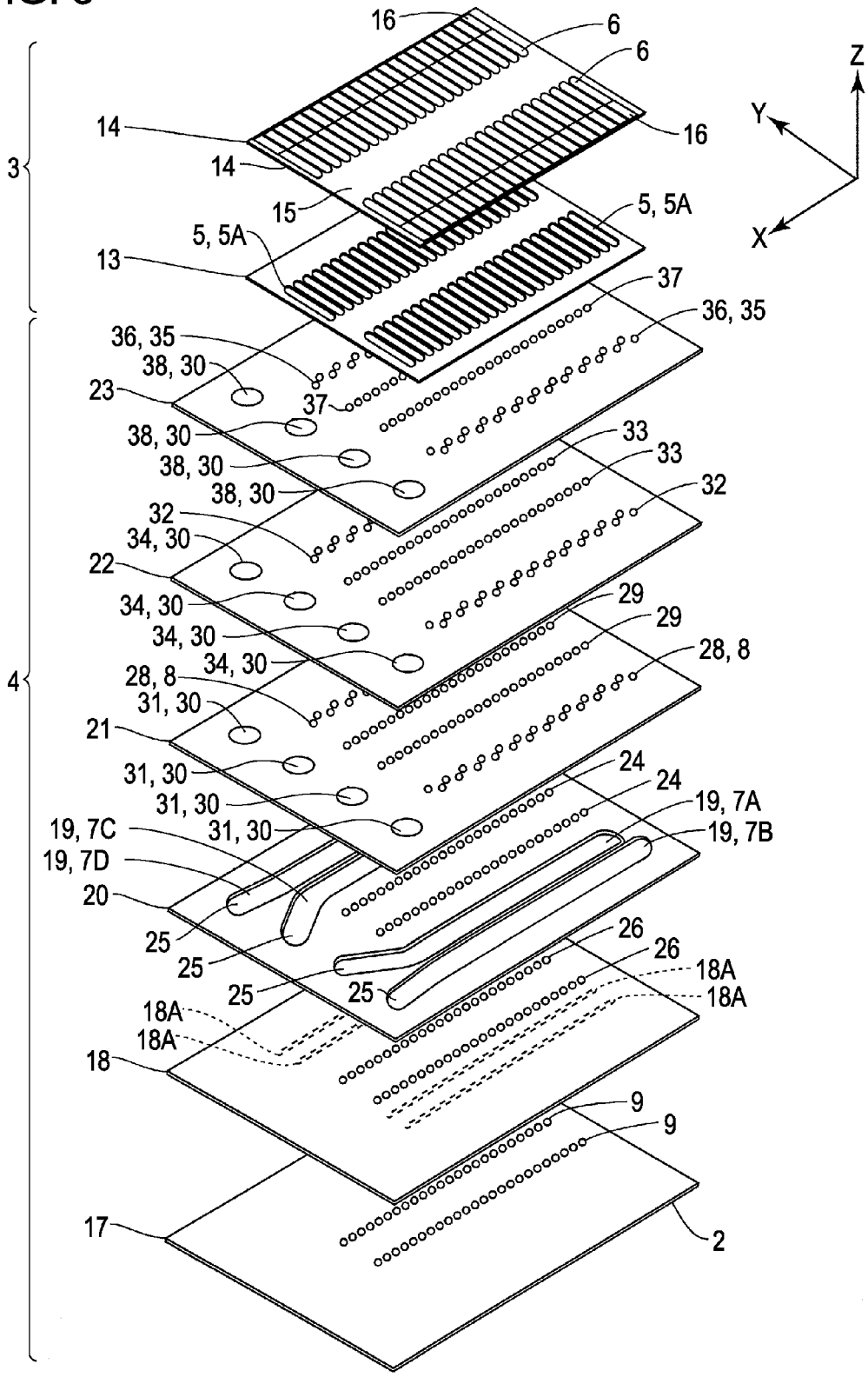
FIG. 3 is an exploded perspective view of the ink head shown in FIG. 2.
Figure 4:
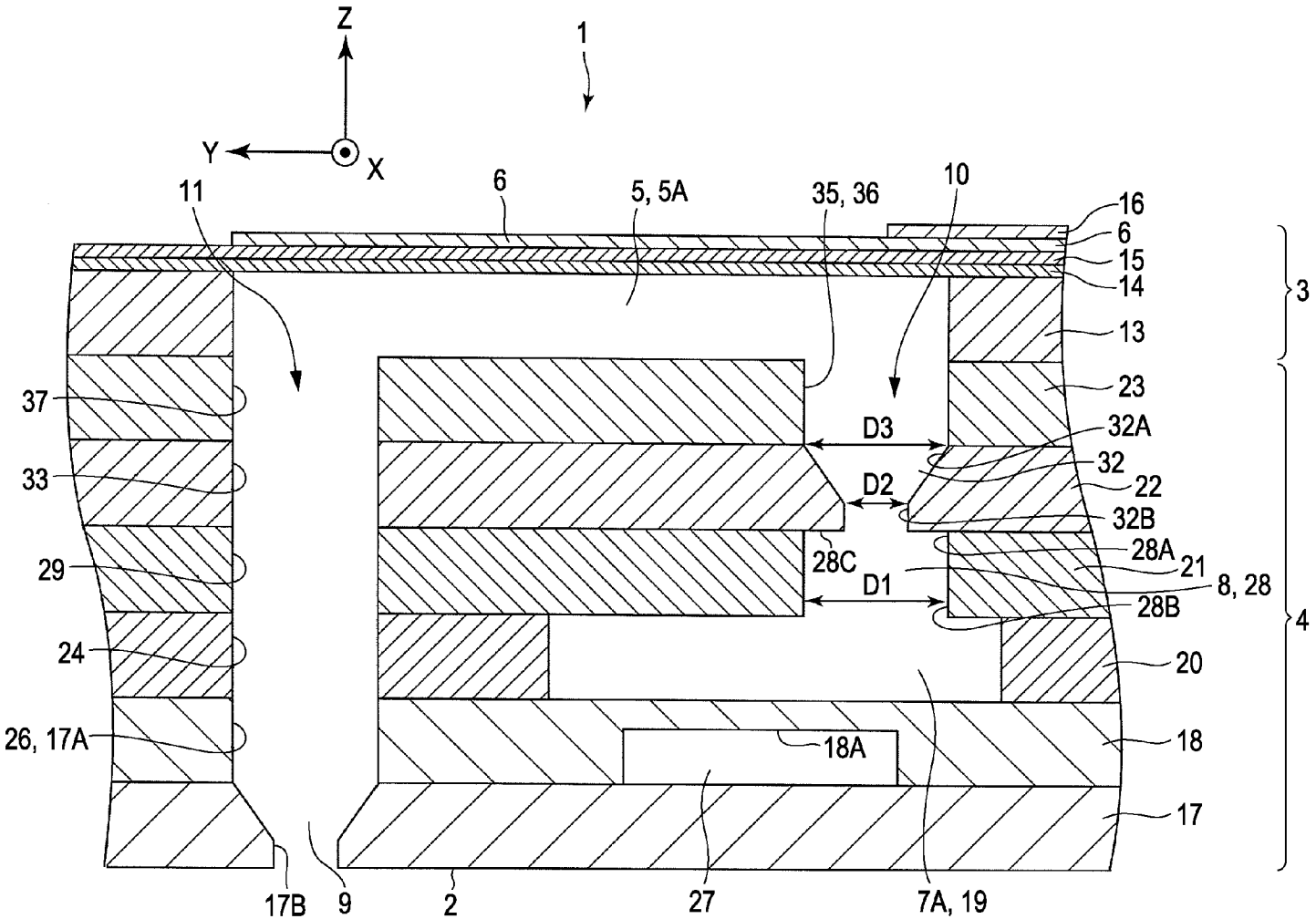
FIG. 4 is a cross-sectional view taken along line IV-IV of FIG. 2.

Hereinafter, a liquid ejecting head such as an ink ejecting head (or "ink head") 1 and a liquid ejecting apparatus that includes the liquid ejecting head, such as an ink jet printer (or "printer") 100 will be described with reference to the drawings. FIG. 1 is a perspective view illustrating the overall configuration of the printer 100 in which the ink head 1 is provided. FIG. 2 is a diagram illustrating the overall configuration of the ink head 1 as seen from above. FIG. 3 is an exploded perspective view illustrating the overall configuration of the ink head 1. FIG. 4 is a partial cross-sectional view illustrating the overall configuration of a cross-section taken along the IV-IV line shown in FIG. 2. The following descriptions refer to the direction of arrow X in FIG. 1 as forward, arrow Y as left, and arrow Z as up. In this description, the side on which the printer 100 rests is the bottom.

The printer 100 includes a carriage 102 to which the ink head 1 is attached. Ink cartridges 101 are removably attached to the carriage 102 for supplying various colors of ink to the ink head 1. The carriage 102 is connected to a carriage motor 104 via a timing belt 103, and moves back and forth in the main scanning direction (horizontal direction) of recording paper P, which serves as a recording medium, while being guided along a guide bar 105. Images, text, and the like are printed onto the recording paper P by ink droplets being ejected from the ink head 1 onto the recording paper P while the ink head 1 moves in the main scanning direction and the recording paper P is moved in the sub scanning direction, which is orthogonal to the main scanning direction. A cleaning mechanism 106 that cleans the ink head 1, and a nozzle protection mechanism 107 that can cover and protect a nozzle surface 2 (see FIGS. 3 and 4) of the ink head 1, are disposed at one end of the main scanning direction.

Referring to FIGS. 2-4, the ink head 1 includes an actuator unit 3 and a flow channel unit 4 (see FIGS. 3 and 4). The actuator unit 3 is provided with multiple pressure generating chambers 5 arranged in rows, and piezoelectric vibrators 6, serving as pressure generating elements, are provided for each of the pressure generating chambers 5. The flow channel unit 4 includes: manifolds 7A, 7B, 7C, and 7D serving as shared flow channels for supplying ink to the multiple pressure generating chambers 5; depressions 8 (see FIGS. 3 and 4) configured to trap bubbles that have been produced due to gas expansion within the manifolds 7A, 7B, 7C, and 7D; and multiple nozzles 9 that communicate with the multiple pressure generating chambers 5.

The ink head 1 produces a change in pressure within the pressure generating chambers 5 as the result of the driving of the piezoelectric vibrators 6. As a result of this change in pressure, ink within the manifolds 7A, 7B, 7C, and 7D flows into the pressure generating chambers 5 from ink supply channels 10 and is then ejected through the nozzles 9 as ink droplets via ink discharge channels 11.

The pair of manifolds 7A and 7B and the pair of manifolds 7C and 7D have symmetrical shapes and dispositions with respect to the row direction of the nozzles 9. The configuration of the pressure generating chambers 5 associated with the manifold 7A is the same as the configurations of the pressure generating chambers 5 associated with each of the manifolds 7B, 7C, and 7D. FIG. 4 is a partial cross-sectional view taken along line IV-IV of FIG. 2, and illustrates the components of one individual ink flow channel, which is associated with the manifold 7A. The flow channels for the manifolds 7B, 7C, and 7D are the same as that illustrated in FIG. 4.

Referring to FIG. 4, the actuator unit 3 includes a pressure generating chamber plate 13, in which cavities 5A that constitute the pressure generating chambers 5 are disposed, and a vibrating plate 14 that is positioned on the opposite side of the pressure generating chamber plate 13 as the flow channel unit 4 and that covers the openings of the cavities 5A. These plates 13, 14 are layered upon each other.

As is best seen in FIGS. 2 and 3, the pressure generating chambers 5 have a length disposed in the Y direction and a shorter width disposed in the X direction). The pressure generating chambers 5 are arranged in rows in the X direction. The horizontal direction in FIG. 4 is the lengthwise direction of the pressure generating chamber 5, i.e. the Y direction. Furthermore, several parallel rows of pressure generating chambers 5 are provided (two in the illustrated embodiment). The pressure generating chambers 5 disposed in one of the rows are configured in such a way that the pressure generating chambers 5 that communicate with the manifold 7A and the pressure generating chambers 5 that communicate with the manifold 7B alternate within the row. Likewise, in the other row, the pressure generating chambers 5 that communicate with the manifold 7C and the pressure generating chambers 5 that communicate with the manifold 7D alternate. Referring to FIG. 2, one end of every other pressure generating chamber 5 disposed in the first row communicates with the manifold 7A via an individual ink supply channel 10. Likewise, one end of every other pressure generating chamber 5 disposed in the first row communicates with the manifold 7B via an ink supply channel 10. Furthermore, the opposite end of every other pressure generating chamber 5 disposed in the second row communicates with the manifold 7C via an ink supply channel 10, and the end of every other pressure generating chamber 5 disposed in the second row communicates with the manifold 7D via an ink supply channel 10.

An electrode 15 is provided upon the vibrating plate 14. A plate-shaped piezoelectric vibrator 6 is provided on the electrode 15 for each of the pressure generating chambers 5. The actuator unit 3 is configured so that the volumes of the pressure generating chambers 5 change due to the driving of the piezoelectric vibrators 6, which makes it possible to increase and decrease the pressure within the pressure generating chambers 5. An electrode 16 is provided for each of the piezoelectric vibrators 6 so that the piezoelectric vibrators 6 can be driven independently from each other. Accordingly, each of the piezoelectric vibrators 6 can cause an independent pressure change in its corresponding pressure generating chamber 5. In the illustrated embodiment, the electrode 15 is used as a common electrode for the multiple piezoelectric vibrators, whereas the electrodes 16 are used as individual electrodes for corresponding piezoelectric vibrators. However, in other embodiments, several electrodes 15 may be used as individual electrodes provided for each of the piezoelectric vibrators, and only one electrode 16 may be a common electrode that spans across the piezoelectric vibrators in the X and Y directions.

As shown in FIGS. 3 and 4, the flow channel unit 4 includes a nozzle plate 17 in which the nozzles 9 are provided, a flexible plate 18, a manifold plate 20 with spaces 19 that constitute the manifolds 7A, 7B, 7C, and 7D, a depression plate 21, a supply opening plate 22, and a communication chamber plate 23, layered in that order from the nozzle plate 17 at the bottom, toward the actuator unit 3.

The multiple nozzles 9, which communicate with respective pressure generating chambers 5 via ink discharge channels 11 provided in the other flow channel plates, are provided in the nozzle plate 17. Each nozzle 9 includes an opening 17A (see FIG. 4) in which the nozzle plate 17 opens toward the flexible plate 18, and a nozzle opening 17B (see FIG. 4), provided on the side opposite the flexible plate 18, through which ink is ejected to the exterior of the ink head 1. The nozzle opening 17B has a smaller diameter than the opening 17A. The nozzles 9 form two rows that parallel the rows of pressure generating chambers 5.

The manifold plate 20 is layered upon the nozzle plate 17 with the flexible plate 18 therebetween. First holes 24 that make up part of respective ink discharge channels 11, and the spaces 19 that constitute the respective manifolds 7A, 7B, 7C, and 7D are provided in the manifold plate 20. The multiple first holes 24 that communicate with a single manifold 7A-D are formed in rows in the X direction. The manifolds 7A, 7B, 7C, and 7D extend in the X direction and communicate with one end of every other pressure generating chamber 5. Furthermore, an ink introduction section 25 (see FIG. 3) is provided at one end of each of the manifolds 7A, 7B, 7C, and 7D for introducing ink into the manifolds 7A, 7B, 7C, and 7D from ink introduction channels 30, mentioned later, which are provided through other plates.

Different colored inks can be introduced into the respective manifolds 7A, 7B, 7C, and 7D from respective ink introduction sections 25, which makes it possible to print using four colors of ink. The inks within the manifolds 7A, 7B, 7C, and 7D corresponding to respective nozzle openings 17B are ejected through those respective nozzle openings 17B.

With this ink head 1, the two manifolds 7A and 7B communicate with one of the rows of the pressure generating chambers 5, and thus two colors of ink are ejected from a single row of pressure generating chambers 5. Likewise, the two manifolds 7C and 7D communicate with the other row, and thus two colors of ink are ejected from the other single row of pressure generating chambers 5.

In this manner, with the ink head 1, two different colors of ink are ejected from a single row of pressure generating chambers 5. Accordingly, the size of the ink head 1 itself can be minimized. In addition, even if the number of manifolds is increased due to an increase in the number of colors of ink to be used, the size of the ink head 1 itself need not be increased significantly.

Note that the manifolds 7A, 7B, 7C, and 7D are configured so that their planar shapes have a gentle curve. Doing so makes it difficult for bubbles to adhere to the inside of the manifolds 7A, 7B, 7C, and 7D, thus preventing ejection problems and so on caused by bubbles.

As shown in FIGS. 3 and 4, the flexible plate 18 is layered on the surface of the manifold plate 20 that faces the nozzle plate 17. Second holes 26 that make up part of respective ink discharge channels 11 and bendable portions 18A are provided in the flexible plate 18. The second holes 26 serve as flow channels that allow the first holes 24 to communicate with the nozzle openings 17B in the ink discharge channels 11. The bottoms of the spaces 19 that form the manifolds 7A, 7B, 7C, and 7D are covered by the flexible plate 18.

The bendable portions 18A are capable of deforming in accordance with changes in the pressure within the manifolds 7A, 7B, 7C, and 7D. Specifically, depressions 27 are provided in the flexible plate 18 on the surface thereof that faces the nozzle plate 17 and in locations that correspond to the manifolds 7A, 7B, 7C, and 7D, and are indented from the side facing the nozzle plate 17 toward the side facing the manifold plate 20. The portion of the flexible plate directly above each depression 27 functions as the bendable portion 18A. Accordingly, sudden changes in the pressure within the manifolds 7A, 7B, 7C, and 7D can be suppressed by the bendable portions 18A deforming. Note that the openings of the depressions 27 that face the nozzle plate 17 are covered by the nozzle plate 17. In some embodiments, the depressions 27 may communicate with the atmosphere through atmosphere communication holes (not shown).

As shown in FIG. 3 and FIG. 4, the depression plate 21 is layered upon the manifold plate 20 on the side thereof that faces the pressure generating chamber plate 13. Depression holes 28 that constitute the depressions 8 are provided in the plate 21 to correspond to the ink supply channels 10. Third holes 29 that make up part of the ink discharge channels 11, and first ink introduction sections 31 that make up part of respective ink introduction channels 30, are also provided in the depression plate 21. The depression plate 21 is layered so as to cover the openings of the spaces 19 that form the manifolds 7A, 7B, 7C, and 7D on the side of the supply opening plate 22 with the exception of the parts corresponding to the depression holes 28 (depressions 8). The bottom portions 28A (see FIG. 4) of the depression holes 28 and the top portions 28B on the top of the depression holes 28 have circular cross-sections, i.e. the depression holes 28 are cylindrical. The diameter D1 of the depression holes 28 is greater than the diameter D2 of openings 32B in first ink supply portions 32, which will be described later.

As shown in FIG. 3 and FIG. 4, the supply opening plate 22 is layered upon the depression plate 21 on the side thereof that faces the pressure generating chamber plate 13. The first ink supply portions 32 that make up part of the ink supply channels 10, fourth holes 33 that make up part of the ink discharge channels 11, and second ink introduction sections 34 that make up part of the ink introduction channels 30, are provided in the supply opening plate 22. The fourth holes 33 provide communication between the pressure generating chambers 5 and the third holes 29. The second ink introduction sections 34 are upstream of the first ink introduction sections 31. The second ink introduction sections 34 communicate with respective manifolds 7A, 7B, 7C, and 7D and are provided in a row in the Y direction. The first ink supply portions 32 are provided in a row in the X direction. In the first ink supply portions 32, the diameter D2 of the openings 32B that open into the manifolds 7A, 7B, 7C, and 7D is smaller than the diameter D3 of openings 32A (see FIG. 4) in the supply opening plate 22.

As shown in FIG. 3 and FIG. 4, the communication chamber plate 23 is layered upon the supply opening plate 22 on the side thereof that faces the pressure generating chamber plate 13. Communication holes 36 that constitute communication chambers 35, fifth holes 37 that make up part of the ink discharge channels 11, and third ink introduction sections 38 that make up part of the ink introduction channels 30 are provided in the communication chamber plate 23. Each of the communication holes 36 corresponds to a respective first ink supply portion 32 in the supply opening plate 22. The diameter of the communication holes 36 is greater than or equal to the diameter D3 of the openings 32A in the first ink supply portions 32 provided in the pressure generating chamber plate 13.

The flow channel unit 4 is thus constituted of the nozzle plate 17, the flexible plate 18, the manifold plate 20, the depression plate 21, the supply opening plate 22, and the communication chamber plate 23 configured as described above. Accordingly, the second holes 26, the first holes 24, the third holes 29, the fourth holes 33, and the fifth holes 37, which form the ink discharge channels 11, communicate in that order from the nozzles 9 to the pressure generating chambers 5.

The depression holes 28 communicate with the manifolds 7A, 7B, 7C, and 7D. Furthermore, the first ink supply portions 32 and the communication holes 36 communicate with the depression holes 28.

Further still, the ink introduction sections 25 of the manifolds 7A-D, the first ink introduction sections 31, the second ink introduction sections 34, and the third ink introduction sections 38 communicate with each other.

The actuator unit 3 is layered upon the flow channel unit 4 configured as described thus far. The communication chambers 35 of the ink supply channels 10 communicate with the pressure generating chambers 5 at one side and the fifth holes 37 of the ink discharge channels 11 communicate with the pressure generating chambers 5 at the other side.

The flow of ink in the ink head 1 configured as described thus far will now be described with reference to FIG. 4.

First, ink flows from the ink cartridge 101 via the ink introduction channels 30 (see FIGS. 2 and 3) to the ink introduction section 25 of the manifold 7A through the ink introduction opening 31. Then, the ink flows from the depressions 8, through the ink supply channels 10, and into the pressure generating chambers 5. The communication chambers 35 are provided in the ink head 1 between the pressure generating chambers 5 and the first ink supply portions 32. This configuration allows the ink to flow more smoothly from the manifold 7A to the pressure generating chambers 5 than if the ink were to flow directly from the manifold 7A to the pressure generating chambers 5 via the first ink supply portions 32. Then, when the pressure generating chambers 5 are pressurized due to the vibration of the piezoelectric vibrators 6, the ink within the pressure generating chambers 5 passes through the ink discharge channels 11 and is ejected to the exterior of the ink head 1 through the nozzle openings 17B.

The other colors of ink from the other manifolds 7B, 7C, and 7D also pass through the ink supply channels 10 and flows into the other pressure generating chambers 5, in the same manner as with the manifold 7A. Then, when the pressure generating chambers 5 are pressurized due to the vibration of the piezoelectric vibrators 6, the ink within the pressure generating chambers 5 passes through the ink discharge channels 11 and is ejected to the exterior of the ink head 1 through the nozzle openings 17B.

Note that in the illustrated embodiment, as shown in FIG. 2 and FIG. 3, four ink introduction channels 30 corresponding to four ink cartridges 101 are provided.

When bubbles are produced within the manifold 7A, because the openings 32B of the ink supply channels 10 are located within the depressions 8, the problem of the prior art in which ink is simultaneously not ejected through several nozzle openings 17B can be prevented.

Figure 5:
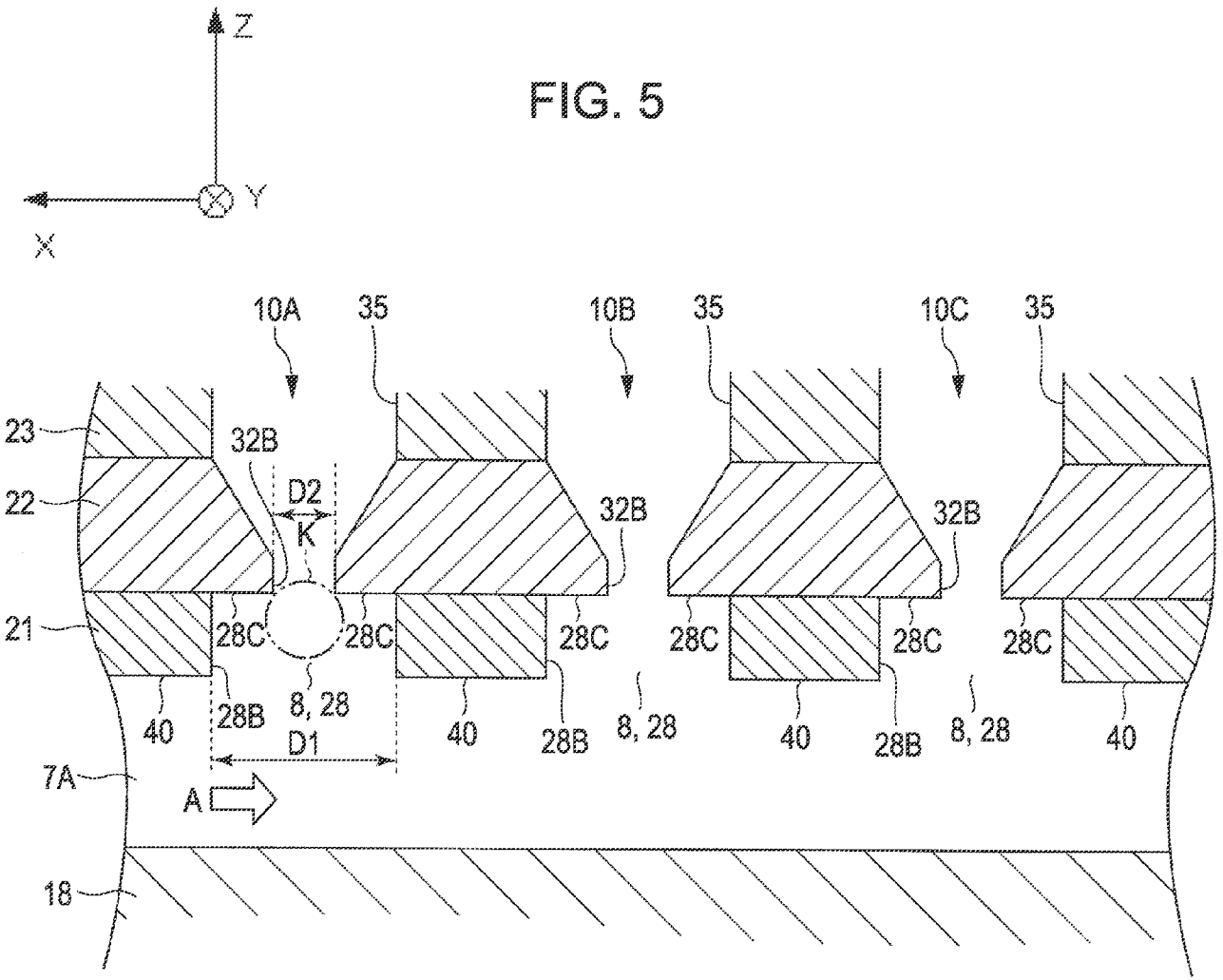
FIG. 5 is a cross-sectional view taken along line V-V of FIG. 2.
Figure 6:
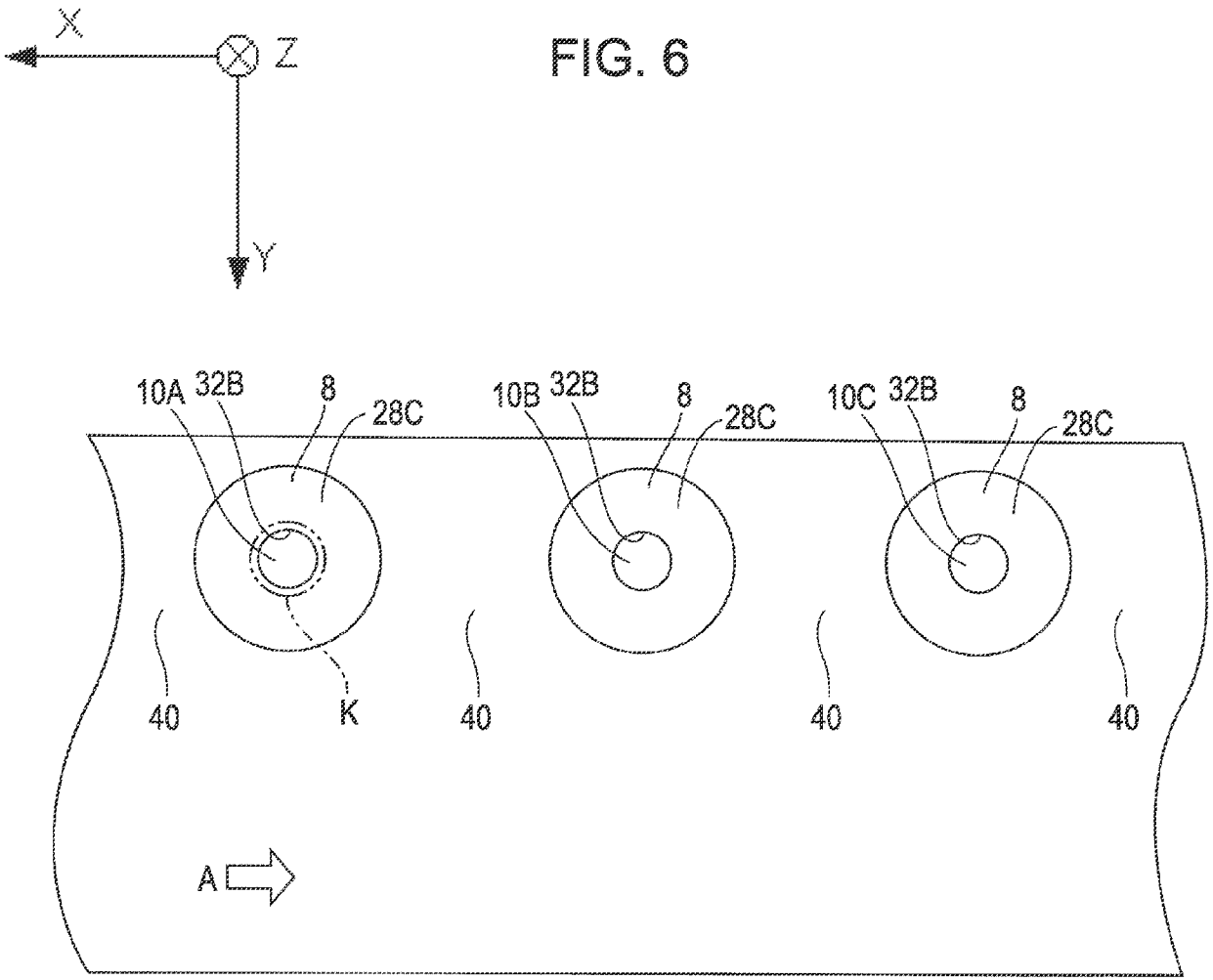
FIG. 6 illustrates the ink head of FIG. 5 viewed from below.

Hereinafter, the configuration of the depressions 8 will be described in detail with reference to FIG. 5 and FIG. 6. FIG. 5 is a cross-section taken along line V-V of FIG. 2. FIG. 6 illustrates the locations of the depressions 8 and the openings 32B as viewed upward from within the manifold 7A in FIG. 5.

In FIG. 5 and FIG. 6, the ink introduction sections 25 are disposed at the left, in the X direction, and the ink within the manifold 7A flows to the right toward the ink supply channels 10 in the direction indicated by arrow A. In FIGS. 5 and 6, three ink supply channels 10A, 10B, and 10C are illustrated, and the ink flows from the left, past the ink supply channel 10A toward the ink supply channel 10C. (It should be understood that some of the ink enters the channel 10A and thus does not move past it in the direction of arrow A; likewise for the other channels 10B and 10C, and the unillustrated channels.)

With the supply opening plate 22 layered upon the depression plate 21, the openings 28A of the depression holes 28 are covered by the supply opening plate 22, and the depression holes 28 thus define depressions 8 having bottoms 28C. As used herein, the term "bottom 28C" is used to refer to the surface that is at the downstream end of the fluid flow through each of the depressions 8, i.e. physically at the top of the depressions 8. The diameter D1 of the depression holes 28 is greater than the diameter D2 of the openings 32B. Furthermore, the relative locations of the depression plate 21 and the supply opening plate 22 are such that the openings 32B are located interior to the openings 28B in the depression holes 28. In other words, the openings 32B of the ink supply channels 10 are disposed in the depressions 8 such that the bottoms 28C surround the openings 32B.

To view this embodiment from a different perspective, a partition 40 is defined between each opening 32B and the adjacent opening 32B, which protrudes toward the manifold plate 20 further than the openings 32B. Thus, even if a bubble K ends up in one of the openings 32B, the bubble K is blocked from moving into other openings 32B by the partition 40.

Main Effects of First Embodiment

Even if a bubble becomes trapped in one of the openings 32B, the bubble K is blocked from moving to the adjacent opening 32B by the partition 40. Thus, the problem of the prior art, namely ink not being ejected through multiple nozzle openings 17B because of bubble K moving to other openings 32B, is prevented. As a result, the printing quality of images, text, or the like that are printed onto the recording paper P is improved.

Variations

Figure 7:
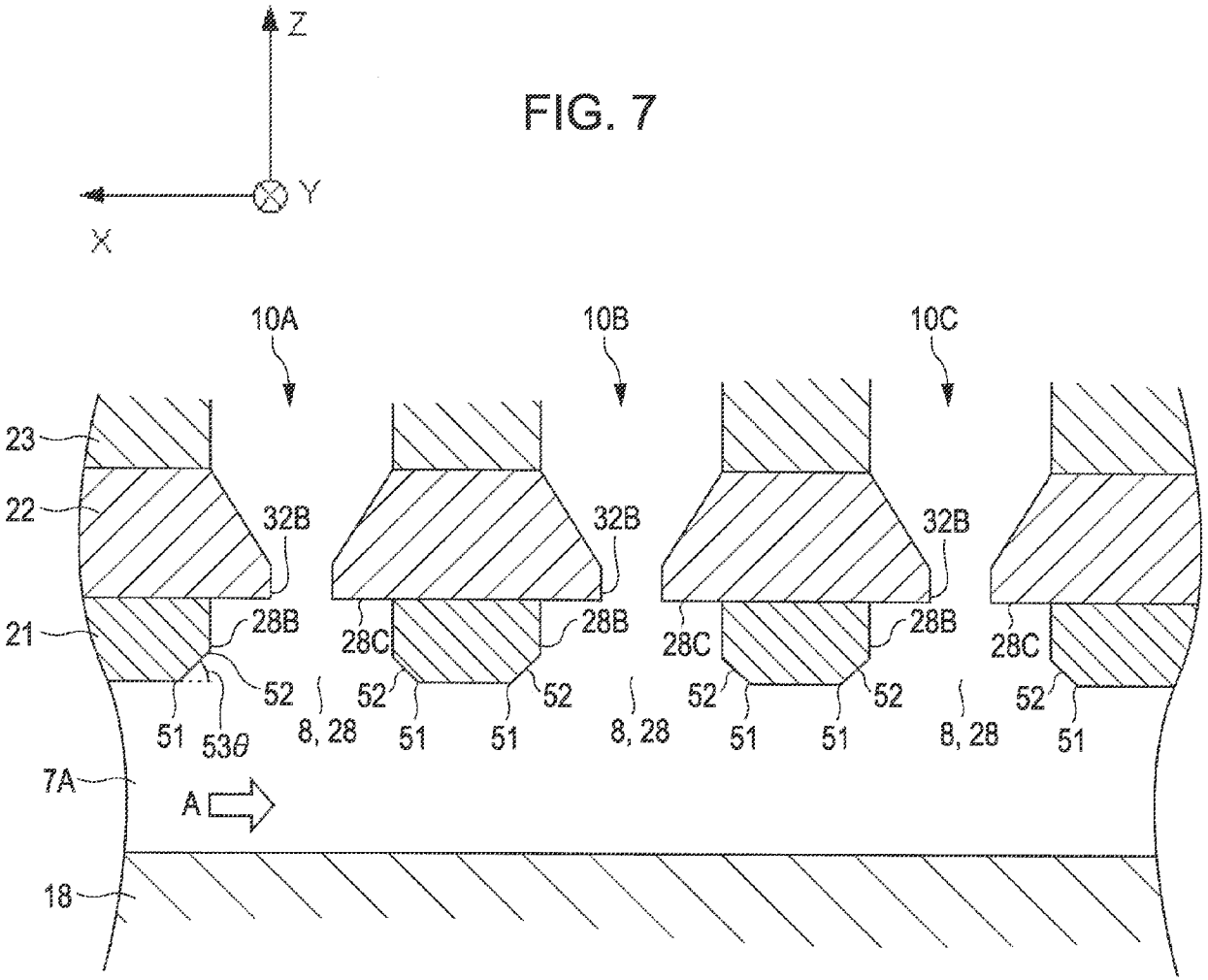
FIG. 7 illustrates a variation on the ink head illustrated in FIG. 5.

As shown in FIG. 7, it is preferable for the circumferential edges of the openings 28B of the depressions 8 that open into the manifolds 7A, 7B, 7C, and 7D to form sloped surfaces 52 that slope inwards toward the bottoms 28C from the edges 51 of the openings 28B. The sloped surfaces 52 are configured such that the diameter of the openings 28B gradually narrows from the edges 51, toward the liquid supply openings 32B.

Bubbles within the depressions 8 remain inside the depressions 8, even during suction cleaning, in which the ink within the ink head 1 is sucked out through the nozzle openings 17B in order to suck out bubbles that have accumulated within the ink supply channels 10, the ink discharge channels 11, or the pressure generating chambers 5.

The sloped surfaces 52 allow the ink to flow smoothly from the periphery of the depressions 8 into the openings 32 without stagnating within the depressions 8. Accordingly, it is easier to discharge the bubbles within the depressions 8 to the exterior through the nozzle openings 17B before the bubbles grow to a size that covers the openings 32. In addition, if there are bubbles large enough to cover the openings 32, they are kept in the depressions 8 as described above, preventing the prior art problem in which ink is not ejected simultaneously through multiple nozzle openings 17B. It should be noted that when the bubbles within the depressions 8 are sucked toward the ink supply channels 10 during printing operations, problems may arise in the ejection of ink through the nozzle openings 17B. Therefore, when bubbles have accumulated in the depressions 8, it is preferable for those bubbles to be kept in the depressions 8 during ejection.

Accordingly, it is preferable to select an appropriate angle of slope 530 of the sloped surfaces 52 to prevent a suction force capable of sucking the bubbles that have accumulated within the depressions 8 into the openings 32B. The angle of slope 530 is selected based on the flow speed, viscosity, and so on of the ink during printing operations, and can be determined, for example, through experimentation.

Furthermore, although the depression holes 28 of the illustrated embodiments are cylindrical, the cross-sectional shape of the depression holes 28 is not limited to a cylinder, and may instead be a polygon such as a triangle, a quadrangle, or the like. However, if it is polygonal, there is the risk that the ink flow will stagnate at the corners, so a cylinder or other rounded shape is preferred.

Note also that the cross-sectional shape taken along the plane of the depressions 8 may be the same from the openings 28A to the openings 28B, or may be slightly different. For example, if the depressions 8 have been formed in the depression plate 21 using a punch, the shape of the depressions 8 is essentially the same from the openings 28A to the openings 28B. However, in the case where the depressions 8 have been formed through etching, the cross-sectional shape from the openings 28A to the openings 28B may be slightly different from place to place.

Second Embodiment

Figure 8:
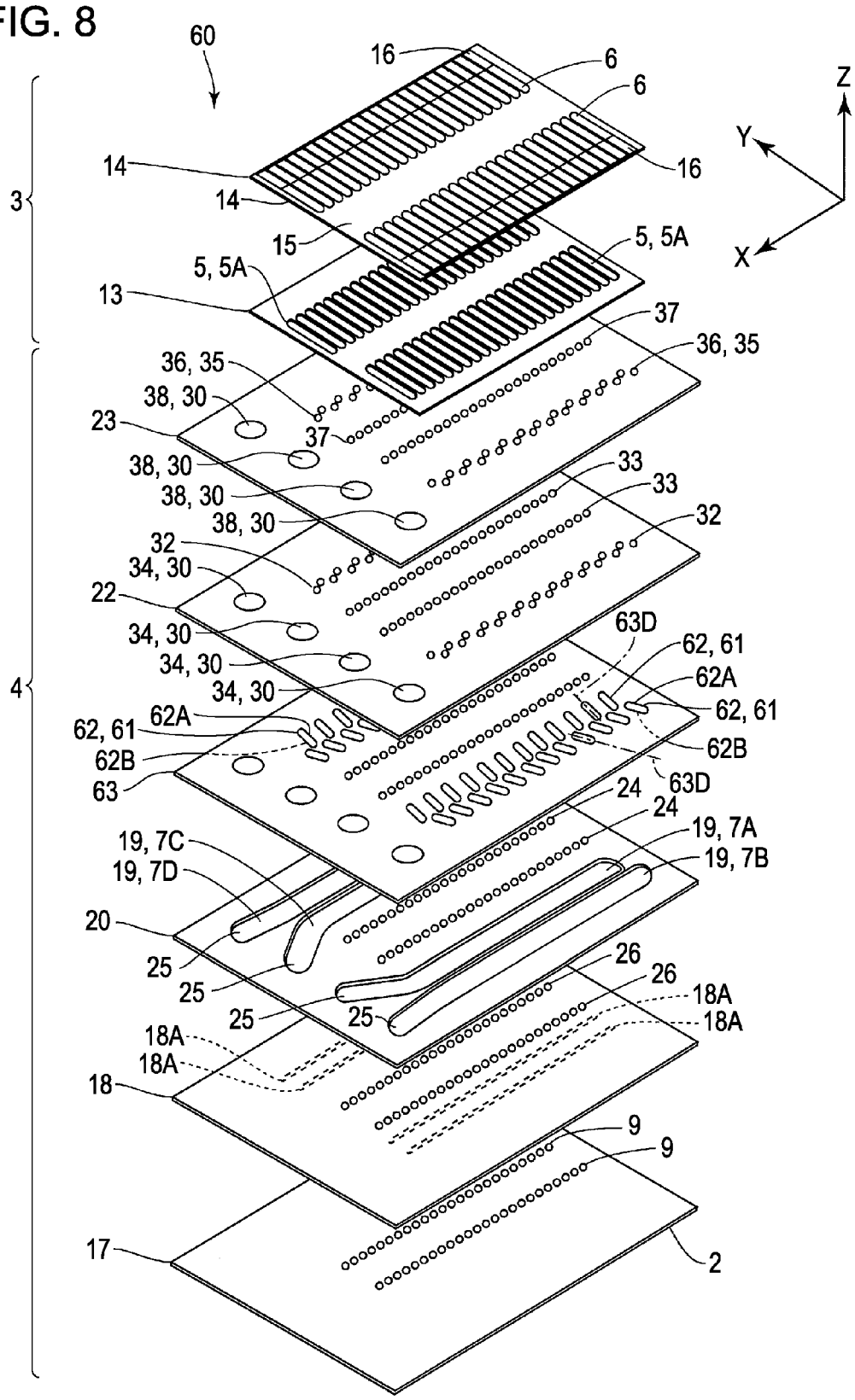
FIG. 8 is an exploded perspective view of a second exemplary ink head.

The liquid ejecting head may be configured as an ink head 60, as shown in FIG. 8. The ink head 60 is similar to the ink head 1 of FIG. 3 other than the configuration of depressions 61. Identical reference numerals will be given to the elements that are similar to those of FIG. 3, and descriptions thereof will be omitted or simplified.

The depressions 61 of the ink head 60 are formed by oblong holes 62 having a length and a width. A depression plate 63, in which the depressions 61 are provided, is layered upon the manifold plate 20 so as to cover the openings in the supply opening plate 22, which open into the spaces 19 that form the manifolds 7A, 7B, 7C, and 7D, with the exception of the areas adjacent the oblong holes 62. Openings 62A of the oblong holes 62 facing the supply opening plate 22 and openings 62B of the oblong holes 62 facing the manifold plate 20 have the same oblong, generally ovoid shape, i.e. the oblong holes 62 have ovoid cross-sections. Furthermore, end surfaces 62C (see FIG. 9) located at both ends of the oblong holes 62 in the lengthwise direction M1 have crescent-shaped surfaces.

Figure 9:
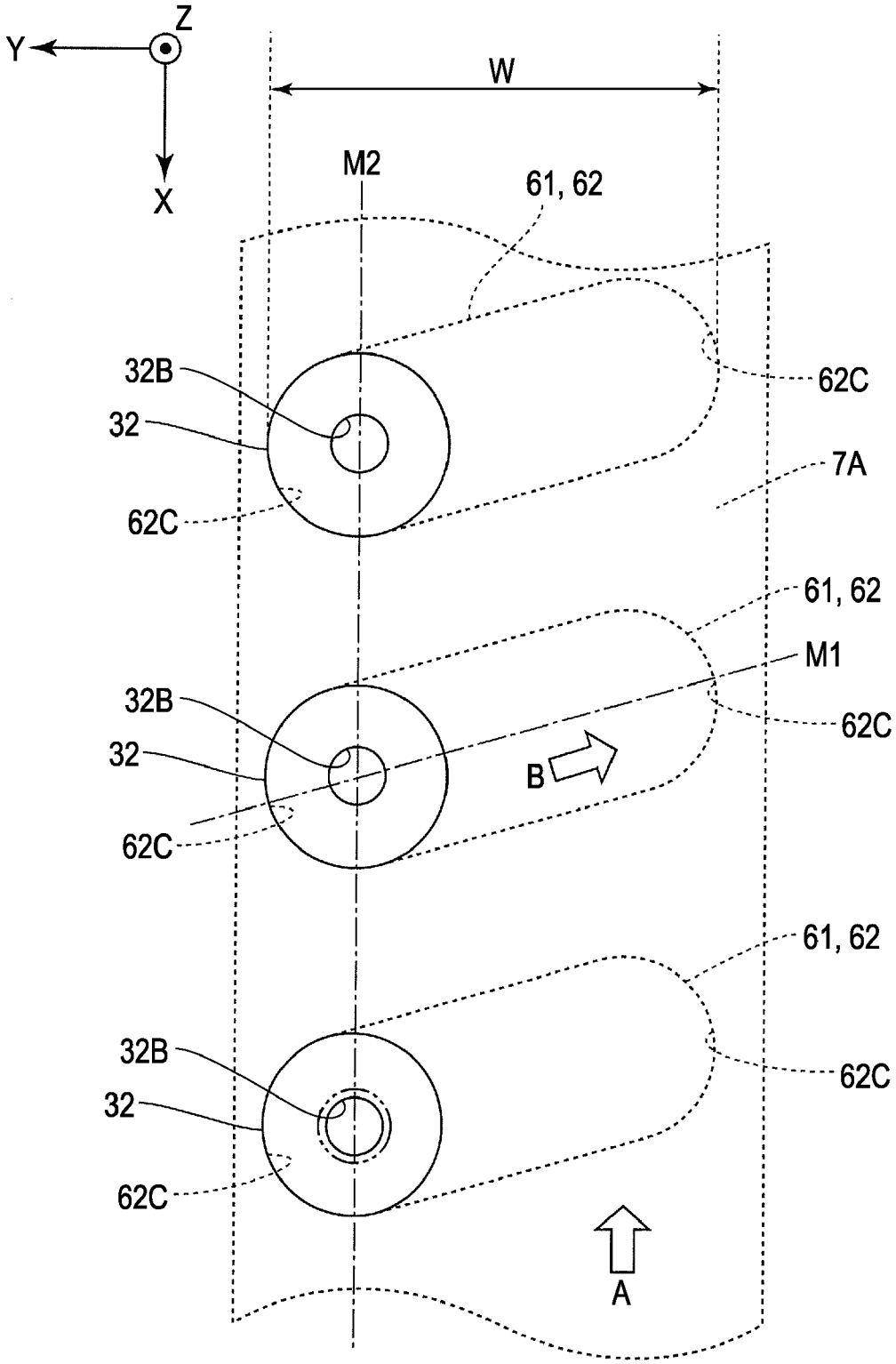
FIG. 9 is a plan view of the supply opening plate shown in FIG. 8.

FIG. 9 is a diagram illustrating the dispositions, shapes, and so on of the openings 32B, the depressions 61 (oblong holes 62), and the manifold 7A, when the manifold plate 20 is viewed from above, i.e. from the direction of the supply opening plate 22. The lengthwise direction M1 of the depressions 61 is transverse to a row direction M2, along which the openings 32B are provided (the X direction).

Main Effects of Second Embodiment

The length of the depressions 61 in the direction M1 can be increased without adjacent openings 32B interfering with each other. In other words, the depressions 61 can have greater volumes than the cylindrical depressions 8 of the first exemplary ink head 1, while avoiding interference between adjacent openings 32B in the row direction M2 (the X direction). Increasing the volume of the depressions 61 makes it easier to keep bubbles within the depressions 61, even in the case where multiple bubbles, large bubbles, or the like have wound up in the depressions 61.

Furthermore, by increasing the volume of the depressions 61, bubbles can be caused to grow within the depressions 61. Bubbles have a property in which the greater the bubble grows, the lower the surface tension of the bubble becomes. Accordingly, increasing the volume of the depressions 61 makes it possible to grow the bubbles within the depressions 61, which yields bubbles with lower surface tension.

Incidentally, there are cases where bubbles that have accumulated within the depressions 61 exit from the depressions 61 (that is, move to the manifold 7A) due to the flow of ink from the ink introduction sections 25 to the openings 32B (in the direction of the arrow A) and so on. However, by increasing the volume of the depressions 61, the bubbles within the depressions 61 can grow, which makes it possible to achieve a reduction in the surface tension of the bubbles that exit the depressions 61. Accordingly, even in the case where the bubbles that have accumulated within the depressions 61 exit from the depressions 61, these bubbles have a lower surface tension than, for example, the largest bubbles that can grow in the depressions 8 of the first exemplary embodiment; thus the bubbles do not easily adhere to the other openings 32B. For this reason, even if the bubbles within the depressions 61 have exited therefrom, the prior art problem of ink simultaneously not being ejected through multiple nozzle openings is prevented.

In addition, the depressions 61 are disposed so that the lengthwise direction M1 is transverse to the row direction M2 and so that the openings 32B are disposed at one end of the lengthwise direction of the depressions 61, such that the distance from the openings 32B to one end is longer than to the other end.

As described above, if ink is continuously ejected when the openings 32B are covered by bubbles, the air accumulates within the pressure generating chambers 5 that communicate with the bubble covered openings 32B, resulting in ink not flowing through the openings 32B to the ink supply channels 10 even if the piezoelectric vibrators 6 are driven. However, in this embodiment, the ink flows within the depressions 61 in the direction away from the openings 32B, as indicated by arrow B in FIG. 9. Note that the flow of ink indicated by the arrow B occurs due to the ink flowing from the ink introduction sections 25 disposed at one end of the manifold 7A toward the other end of the manifold 7A, in the –X direction (see FIG. 8). Since the –X direction has a component in the B direction, the ink is guided in the B direction within the openings 32B.

As a result of the ink flowing in the B direction within the depressions 61, the bubbles that cover the openings 32B also move in the B direction, i.e. away from the openings 32B. When the bubbles have moved away from the openings 32B, the ink flows into the ink supply channels 10, and there is the possibility that ink will once again be ejected through the nozzle openings 17B that communicate with the openings 32B that were covered by the bubbles.

The oblong shape of the depressions 61 makes it more likely that the bubbles within the depressions 61 will take on an elliptical shape. The reason for this is thought to be that a force in the B direction acts on the bubbles that cover the openings 32B, which makes it more likely for those bubbles to take on an elliptical shape that is longer in the lengthwise direction M1. Ensuring that the bubbles take on an elliptical shape makes it easier to cause bubbles that have been sucked into the openings 32B to move, and also causes bubbles that have separated from the openings 32B to quickly move away from the openings 32B. Furthermore, the surface tension of elliptical bubbles is lower than that of spherical bubbles.

It should be noted that in this embodiment, the lengthwise direction M1 of the depressions 61 slopes from front to back, or in other words, slopes from the side on which the ink introduction sections 25 of the manifold 7A are disposed toward the direction in which the ink flows (that is, the direction indicated by the arrow A). Thus, the ink flows more effectively within the depressions 61 away from the openings 32B (that is, the B direction). In addition, by the direction M1 being sloped rather than orthogonal to the row direction M2, a width W in the direction in which the depressions 61 are disposed can be narrower, which in turn makes it possible to dispose the depressions 61 more efficiently across the width of the manifold 7A.

In the illustrated embodiment, the oblong holes 62 are ovoid; however, the shape of the oblong holes 62 is not limited to an oval, and may instead be, for example, a rectangle with its length in the direction M1. However, if the holes 62 are rectangular, there is the risk that the flow of ink will stagnate at the corners. As opposed to this, providing ovoid holes 62 so that the end surfaces in the lengthwise direction M1 are also arc-shaped surfaces, makes it possible for the ink to flow smoothly within the depressions 61.

Figure 10A:
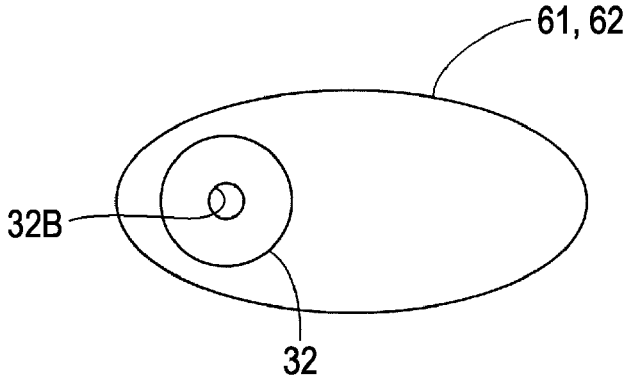
FIGS. 10A, 10B, and 10C illustrate variations on the depressions shown in FIG. 9.
Figure 10B:
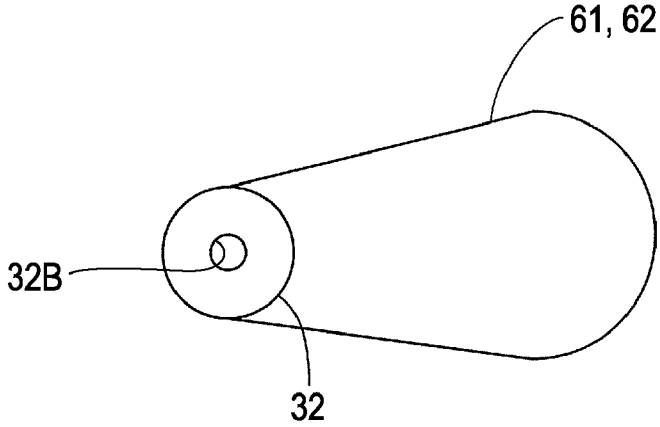
Figure 10C:
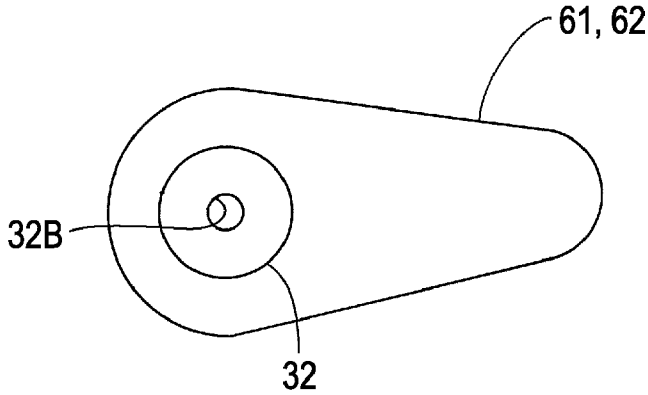

Note that the depressions 61 may have cross-sectional shapes such as those illustrated in FIG. 10A, FIG. 10B, and FIG. 10C. In addition, the depressions 61 may extend in any direction in the X-Y plane. Note also that the cross-sectional shape taken along the plane of the depressions 61 may be the same from the openings 62A to the openings 62B, or may be slightly different.

In the aforementioned first and second embodiments, one depression 8 or 61 is provided for each of the openings 32B. However, the depressions 8 or 61 may be provided for every other opening 32B, every three openings 32B, and so on. The openings 32B are typically packed very densely, such as, for example, 180 dpi, 360 dpi, or the like. Accordingly, providing the depressions 8 or 61 every few openings 32B makes it easier to form the depressions 8 or the depressions 61. Alternatively, multiple openings 32B may be located in a single depression 8 or 61. In this case as well, it is easier to form the depressions 8 or the depressions 61 for the openings 32B, which are densely packed.

In the aforementioned first and second embodiments, the depressions 8 or 61 are provided in the depression plate 21. Alternatively, the depression plate 21 may not be provided, and instead, partitions may be provided on the supply opening plate 22 from the manifold plate 20 to the interior of the manifolds 7A, 7B, 7C, and 7D, with the partitions provided between adjacent liquid supply openings 32B to prevent bubbles that cover one of the openings 32 from moving toward the other openings 32.

The depression plates 21 and 63 in the aforementioned first and second embodiments, respectively, can be formed of, for example, a metallic material such as SUS (stainless steel), copper, or brass, a ceramic material such as zirconia, alumina, or ferrite, a silicon material such as single-crystal silicon, polycrystal silicon, or amorphous silicon, a resin material such as polyethylene or polyimide, and so on. Incidentally, it is more difficult for bubbles to adhere to a surface that has a lower (worse) wettability. Accordingly, depression plates 21 and 63 of a material with a low wettability to hold the bubbles that have accumulated within the depressions 8 or 61 within those depressions better than plates with high wettability. Therefore, it is preferable to use a ceramic material or a resin material, which have lower wettabilities than metallic or silicon materials.

Third Embodiment

Figure 11:
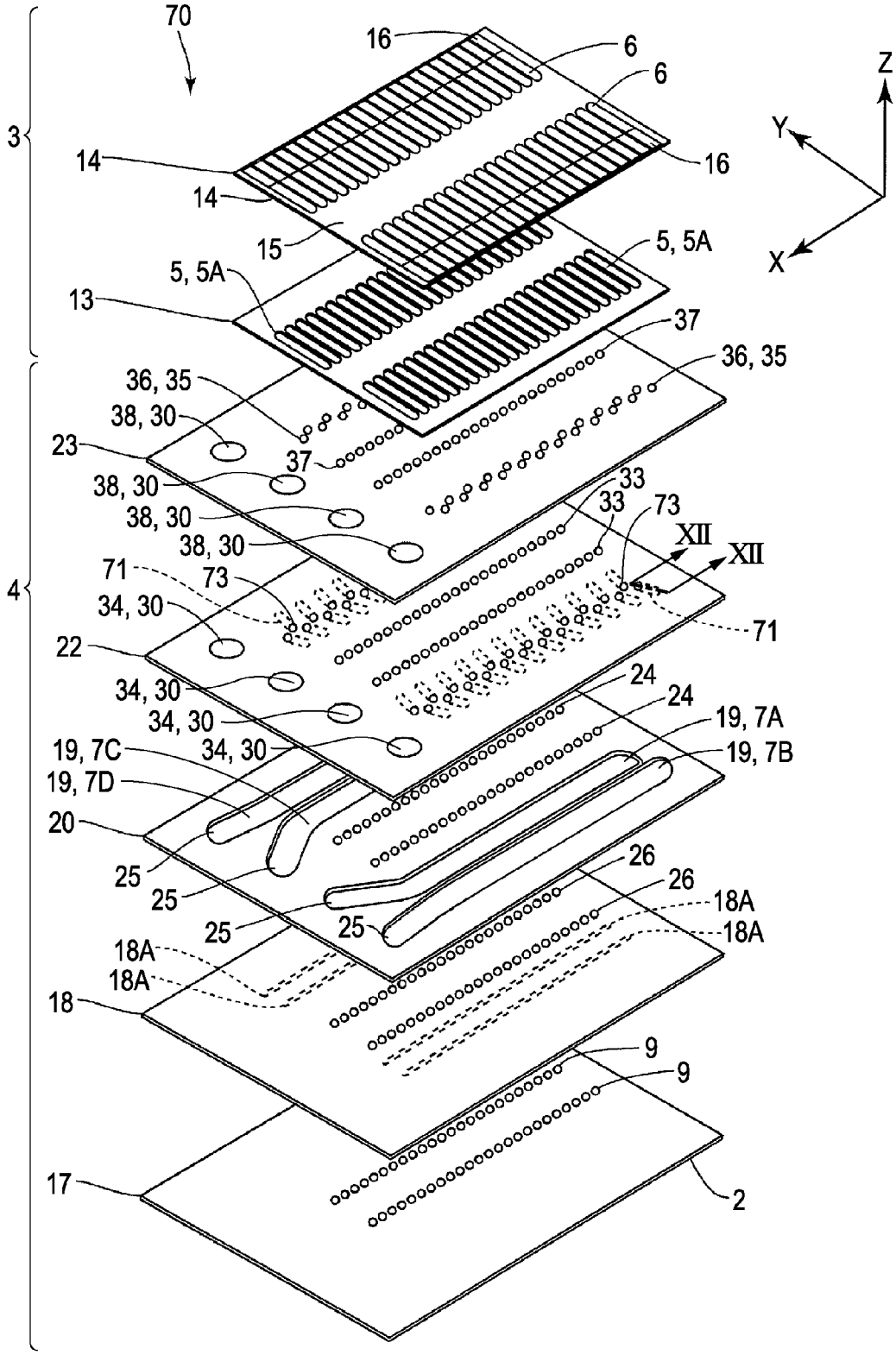
FIG. 11 is an exploded perspective view of a third exemplary ink head.
Figure 12:
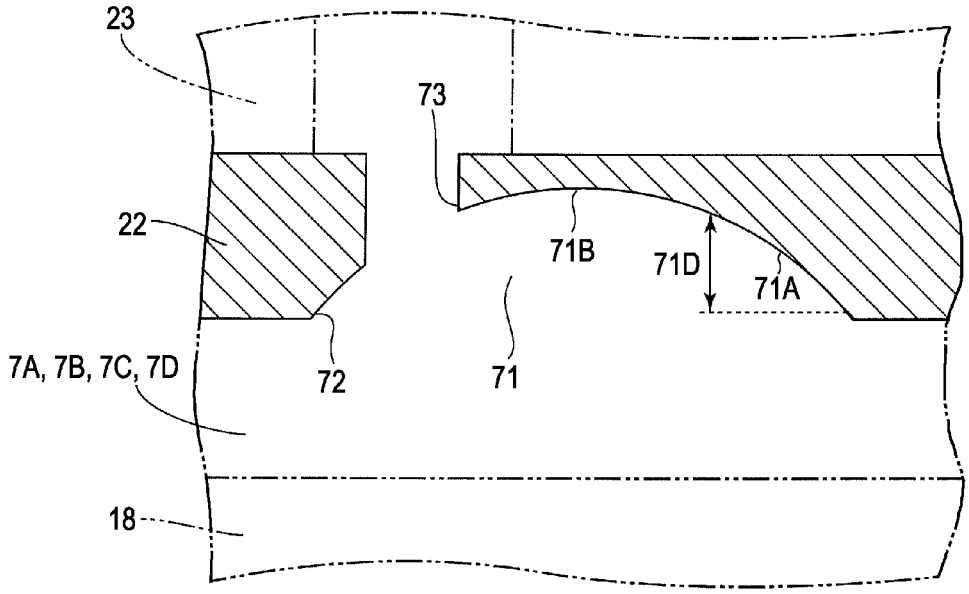
FIG. 12 is a cross-sectional view taken along line XII-XII of FIG. 11.

The liquid ejecting head may be configured as an ink head 70, as shown in FIGS. 11 and 12. FIG. 11 is an exploded perspective view illustrating the ink head 70. FIG. 12 is a cross-sectional view of the supply opening plate 22 taken along line XII-XII of FIG. 11. In this embodiment, the depression plate 21 is not provided. Instead, depressions 71 are provided in the supply opening plate 22. Other than the omission of the depression plate 21 and the relocation of the depressions 71, the ink head 70 is similar to the ink head 60. Therefore, constituent elements that are similar to those in the ink head 60 will be given identical reference numerals, and descriptions thereof will be omitted or simplified.

As shown in FIG. 12, the depressions 71 are configured so that a height 71D increases from an opening 72 toward the center of the depression 71. To rephrase, the depressions 71 are dome shaped so that a top surface 71A of the depressions 71 is higher near the center of the depression 71. Furthermore, a liquid supply opening 73 is provided in each of the depressions 71 at a location that is lower than an apex 71B, which is the uppermost location in the top surface 71A. Note that while the X, Y, and Z directions have been used throughout the specification mostly for ease of description, in this case, referring back to FIG. 1, the apex 71B is the uppermost location in the top surface 71A when the ink head 70 is actually ejecting ink, or in other words, when the ink head 70 is installed in the printer 100 and the printer 100 is set rightside up on a work surface.

Figure 13:
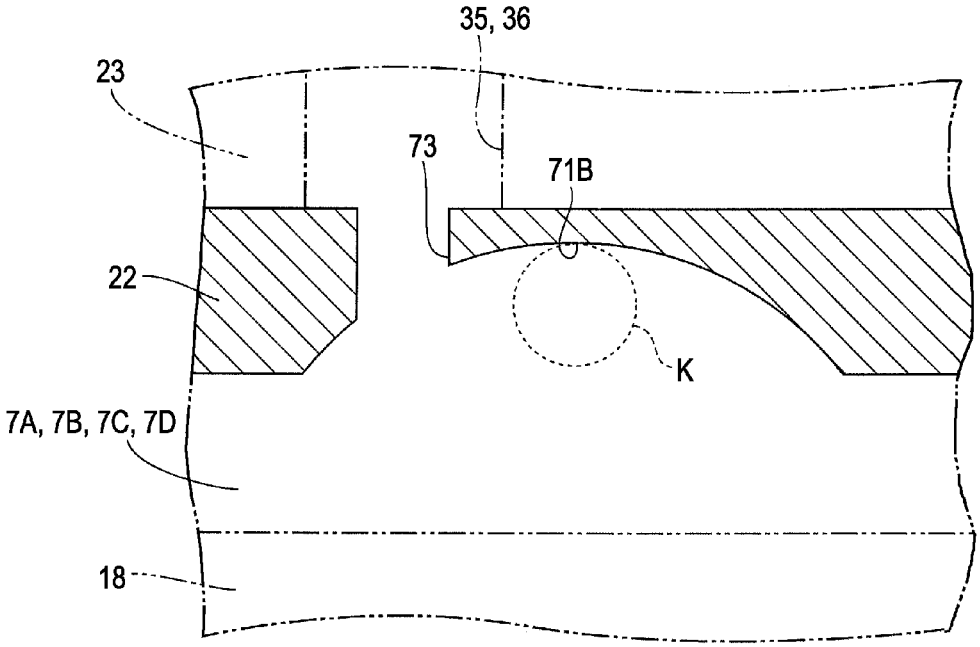
FIG. 13 illustrates a state in which a bubble has grown in the uppermost area of the depression illustrated in FIG. 12.

In such a depression 71, the opening 73 is unlikely to become blocked by bubbles. Bubbles tend to move toward higher areas due to their density being lower than that of the ink. Accordingly, bubbles present in the depressions 71 will tend to move toward the apex 71B, as indicated by the bubble K shown in FIG. 13. Accordingly, the opening 73 being lower than the apex 71B of the top surface 71A prevents the opening 73 from being blocked by the bubble K.

Figure 14:
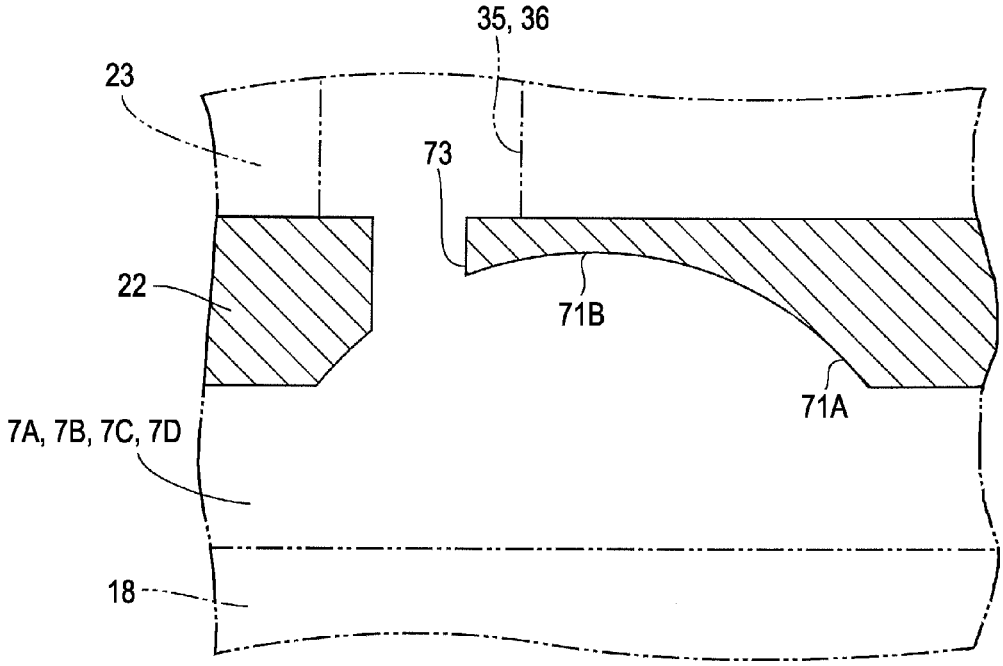
FIG. 14 illustrates a variation on the depression illustrated in FIG. 12.

Note that as shown in FIG. 14, providing the opening 73 as close as possible to the edge of the depression 71 causes the bubbles within the depressions 71 to move as far as possible from the opening 73, thereby reducing the risk that the bubbles that have been distanced from the opening 73 will once again be sucked into the opening 73.

The depressions 71 can in some embodiments be formed through an etching process, depending on the material of the supply opening plate 22. Etching the depressions makes it easy for the etching depth to become greater at the center, creating the dome shape. The openings 73 are then formed in the depressions 71, for example, using a punch. The supply opening plate 22 and the communication chamber plate 23 are then layered together so that the openings 73 and communication chamber holes 36 are positioned relative to each other.

The etching process by which the depressions 71 are formed may be designed so that the length of time of the etching process is different at the areas corresponding to the apex 71B and the other areas, to form the desired shape. To be more specific, for example, the areas near the edges are masked; the etching process is then carried out on the areas corresponding to the uppermost areas 71B, the masking is removed, and the etching process is then carried out on the uppermost areas 71B and the other areas as well. Alternatively, the depressions 71 can be formed through, for example, laser processing. The openings 73 may also be formed through laser processing.

In the aforementioned third embodiment, one depression 71 is provided for each of the multiple openings 73. However, the depressions 71 may alternatively be provided at every other opening 73, every three openings 73, and so on. The openings 73 are densely packed, such as, for example, 180 dpi, 360 dpi, or the like. Accordingly, providing the depressions 71 every few openings 73 makes it easier to form the depressions 71. Alternatively, multiple openings 73 may be provided within a single depression 71. In this case as well, it is easier to form the depressions 71 for the openings 73, which are disposed at narrow intervals.

The supply opening plate 22 in the aforementioned third embodiment can be formed of, for example, a metallic material such as SUS (stainless steel), copper, or brass, a ceramic material such as zirconia, alumina, or ferrite, a silicon material such as single-crystal silicon, polycrystal silicon, or amorphous silicon, a resin material such as polyethylene or polyimide, and so on. It is more difficult for bubbles to adhere to a surface that has a lower (worse) wettability. Accordingly, a the supply opening plate 22 with low wettability holds the bubbles that have accumulated within the depressions 71 within those depressions better than plates with high wettability. Therefore, it is preferable to use a ceramic material or a resin material, which have lower wettabilities than metallic or silicon materials.

Although a liquid ejecting apparatus is embodied as an ink jet printer in the aforementioned embodiments, the invention is not limited thereto. The invention also encompasses liquid ejecting apparatuses that eject liquids other than ink, or liquid-like substances such as liquid bodies in which the particles of a functional material are dispersed throughout or mixed with a liquid, fluids such as gels, and solids that flow and can be ejected like liquids, such as granular solids). For example, the invention may be embodied as a liquid ejecting apparatus that ejects electrode materials, coloring materials (pixel materials), and so on in a dispersed or dissolved state for use in the manufacture and so on of liquid-crystal displays, electroluminescence (EL) displays, and front emission displays; a liquid ejecting apparatus that ejects bioorganic matters used in the manufacture of biochips; a liquid ejecting apparatus that ejects liquids to be used as samples for precision pipettes; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; liquid ejecting apparatus that eject an etching liquid such as an acid or alkali onto a substrate or the like for etching; and fluid ejecting apparatuses that eject fluids such as gels (for example, physical gels). Note that the term "fluid" as used herein does not refer to gases; rather, "fluid" refers to liquids and liquid-like materials such as gels and granular solids.

What is claimed is:

1. A liquid ejecting head comprising:

multiple pressure generating chambers;

nozzles that communicate with respective pressure generating chambers;

a manifold that communicates with a liquid introduction opening and that serves as a common flow channel for the multiple pressure generating chambers;

liquid supply channels, having liquid supply openings that open into the manifold, that communicate between the manifold and the pressure generating chambers; wherein at least one of the liquid supply openings is physically separated from at least one adjacent one of the liquid supply openings; and a pressure generating element that causes liquid to be ejected through the nozzles by generating pressure within the pressure generating chambers.

2. The liquid ejecting head according to claim 1, wherein the physically separated comprises a partition between the liquid supply opening and the adjacent liquid supply opening.

3. The liquid ejecting head according to claim 1, wherein the physically separated comprises a depression that has an opening that opens into the manifold, wherein the liquid supply opening is disposed in the depression.

4. The liquid ejecting head according to claim 3, wherein the depression is substantially cylindrical, and wherein the liquid opening is substantially circular and located substantially concentrically within the depression.

5. The liquid ejecting head according to claim 3, wherein the depression has an oblong shape having a length and a width, and the length is disposed in a direction that has a component along a downstream direction of liquid within the manifold.

6. The liquid ejecting head according to claim 5, wherein the liquid supply opening is disposed closer to an upstream end of the depression than a downstream end of the depression.

7. The liquid ejecting head according to claim 3, wherein the depression has a cross-section that narrows in an upward direction.

8. The liquid ejecting head according to claim 7, wherein the depression is substantially dome-shaped.

9. The liquid ejecting head according to claim 7, wherein the depression comprises an apex which, when the liquid ejecting head is installed in a liquid ejecting apparatus that is set rightside up, is an uppermost position of the depression.

10. The liquid ejecting head according to claim 9, wherein the liquid supply opening is located in a position that is lower than the apex.

11. The liquid ejecting head according to claim 3, wherein the depression comprises a sloped surface that tapers inward in an upward direction.

12. The liquid ejecting head according to claim 3, comprising one depression for each of the plurality of liquid supply openings.

13. The liquid ejecting head according to claim 3, wherein some of the liquid supply openings are not associated with depressions.

14. The liquid ejecting head according to claim 3, wherein the depression has a plurality of liquid supply openings disposed therein.

15. A liquid ejecting apparatus comprising the liquid ejecting head according to claim 1.

16. A liquid ejecting head, comprising:

a pressure generating chamber plate defining pressure generating chambers therein;

a vibrating plate disposed above the pressure generating plate and defining a pressure generating element for generating pressure within the pressure generating chambers;

a nozzle plate defining nozzles that communicate with respective pressure generating chambers, wherein the pressure generating element is configured to cause liquid to be ejected through the nozzles;

a manifold plate disposed above the nozzle plate and defining a manifold that communicates with a liquid introduction opening and that serves as a common flow channel for the multiple pressure generating chambers;

a communication chamber plate disposed below the pressure generating chamber plate and defining liquid supply channels; and a supply opening plate disposed between the manifold plate and the communication chamber plate and defining liquid supply openings that open into the manifold, that communicate between the manifold and the liquid supply channels; wherein at least one of the liquid supply openings is physically separated from at least one adjacent one of the liquid supply openings.

17. The liquid ejecting head of claim 16, further comprising a depression plate disposed between the manifold plate and the supply opening plate, and defining at least one depression therein, wherein the liquid supply opening is disposed in the depression to thereby be physically separated from the adjacent liquid supply opening.

18. The liquid ejecting head of claim 16, wherein the supply opening plate defines at least one depression therein, wherein the liquid supply opening is disposed in the depression to thereby be physically separated from the adjacent liquid supply opening.

19. The liquid ejecting head of claim 18, wherein the depression is substantially dome-shaped.

20. A liquid ejecting apparatus comprising the liquid ejecting head according to claim 16.

21. A method of manufacturing a liquid ejecting head, comprising:

providing a pressure generating chamber plate, which defines pressure generating chambers therein;

attaching a vibrating plate above the pressure generating plate, where the vibrating plate comprises a pressure generating element for generating pressure within the pressure generating chambers;

providing a nozzle plate, which defines nozzles for communicating with respective pressure generating chambers, wherein the pressure generating element is configured to cause liquid to be ejected through the nozzles;

attaching a manifold plate above the nozzle plate, where the manifold plate defines a manifold that communicates with a liquid introduction opening and that serves as a common flow channel for the multiple pressure generating chambers;

attaching a communication chamber plate below the pressure generating chamber plate, where the communication chamber plate defines liquid supply channels;

attaching a supply opening plate below the communication chamber plate, where the supply opening plate defines liquid supply openings configured to open into the manifold, for communicating between the manifold and the liquid supply channels;

providing a depression plate substrate;

forming at least one depression in the depression plate substrate to thereby form a depression plate; and attaching the depression plate between the manifold plate and the supply opening plate such that at least one of the liquid supply openings is disposed in the depression, such that the depression physically separates the liquid supply opening from at least one adjacent one of the liquid supply openings.

22. The method of claim 21, wherein forming the at least one depression comprises etching.

23. The method of claim 22, wherein the etching comprises masking near edges of the depression, etching interior to the edges with the edges masked, removing the masking, and etching the edges and the interior simultaneously, such that the depression has a cross-section that narrows in an upward direction.

24. The method of claim 21, wherein forming the at least one depression comprises laser processing.

* * * * *